United States Patent [19]

Kleim

[11] 4,175,495

[45] Nov. 27, 1979

[54] ENTRANCE STEP ARRANGEMENT FOR A SHORT DISTANCE TRANSPORT VEHICLE

[75] Inventor: Karl-Heinz Kleim, Nürnberg, Fed. Rep. of Germany

[73] Assignee: Maschinenfabrik Augsburg-Nürnberg Aktiengesellschaft, Nürnberg, Fed. Rep. of Germany

[21] Appl. No.: 795,755

[22] Filed: May 11, 1977

[30] Foreign Application Priority Data

May 11, 1976 [DE] Fed. Rep. of Germany ..... 2620683

[51] Int. Cl.[2] ..... B61D 23/02; B61K 13/04; B60R 3/02

[52] U.S. Cl. ..... 105/450; 105/427; 105/429; 105/438; 105/443; 182/77; 182/88; 244/129.6; 280/166

[58] Field of Search ..... 105/343, 425–435, 105/437, 438, 443–450; 280/163, 166, 164 R; 244/129.6; 296/62; 182/77, 88

[56] References Cited

U.S. PATENT DOCUMENTS

| | | | |
|---|---|---|---|
| 623,401 | 4/1899 | Gray | 105/432 |
| 1,102,287 | 7/1914 | Moller | 105/437 |
| 1,149,482 | 8/1915 | Veiox | 105/431 |
| 1,397,294 | 11/1921 | Reeder | 105/431 |
| 2,190,742 | 2/1940 | Udstad | 105/427 |
| 3,795,205 | 3/1974 | Gritchen et al. | 105/450 |
| 3,924,545 | 12/1975 | Anders et al. | 105/450 |

FOREIGN PATENT DOCUMENTS

| | | | |
|---|---|---|---|
| 306184 | 2/1929 | United Kingdom | 105/437 |

*Primary Examiner*—Randolph A. Reese
*Attorney, Agent, or Firm*—Becker & Becker, Inc.

[57] ABSTRACT

An entrance step arrangement particularly for short distance vehicles, especially rail vehicles, which has at least one intermediate step, a cover for covering up the step or steps, a foldable guard plate, and transmission elements interposed between a drive and movable element, and safety devices for preventing faulty actuation of the cover, guard plate, and transmission elements. The axes of rotation of the movable elements are arranged horizontal and parallel to the outer contour of the vehicle. The guard plate which is foldable outwardly carries a step, and the step cover is pivotable inwardly behind the tread edge of the floor of the vehicle.

15 Claims, 14 Drawing Figures

13
14
25
9
8
5
B
6
26
10
7
27
29
18
11'
37
24
23
22
1
13
3
32
A
33
20
19
31
2
11'
12
35
37
50

ENTRANCE STEP ARRANGEMENT FOR A SHORT DISTANCE TRANSPORT VEHICLE

This invention relates to an entrance step arrangement for a short distance vehicle, especially a rail vehicle with at least one intermediate step, a step cover, and a foldable guard plate. The arrangement according to the invention furthermore comprises transmission means between a drive and movable elements, and also comprises safety devices for preventing faulty actions, while the axes of rotation of the movable elements are horizontal and parallel to the outer contour of the vehicle.

Short distance vehicles, such as urban transport vehicles in particular, present a problem in that they are used on routes where high-level platforms exist, which is the case mostly on underground or elevated sections of the route, ae well as stops where passengers alight and board the vehicle, i.e. get on and off platforms at the level of the surrounding ground. Various solutions have been proposed to overcome this problem.

For instance, a folding step is known with a lower fixed bottom step and with an upper folding-type cover and with a pivotable guard plate. In its folded-down position one section of the cover serves as a relatively narrow step. The guard plate is connected to the step cover by means of a linkage movable by means of an actuating mechanism. Since this folding-type step can be made with only three steps, it fails to meet today's standards of comfort (German Auslegeschrift No. 1 605 042).

According to a further development of this folding-step system, an additional step is provided below the fixed step and movably jointed to the recess cover provided at the vehicle floor in a manner causing it to move vertically and laterally by linkages in a level position as the vehicle door is opened or closed. Especially during winter operation, this known configuration is liable to be interfered with by slush thrown up and freezing in place. Even during surface operation under conditions similar to tramways, constant troubles are to be expected in consequence of dirt accumulations occasioned by this design (German Offenlegungsschrift No. 2 423 467).

Similar problems also arise in another movable step arrangement which comprises at least one fixed step offset downwardly relative to the floor level of the vehicle and located in a step box and another step or cover which is slidable vertically and laterally. To increase the size of the step opening this design may also include a floor section arranged at floor level and slidable or foldable. In order to move the individual parts of this step arrangement into desired positions, a rather complicated linkage is required (German Offenlegungsschrift 2 158 724).

Still another step arrangement with only two steps is designed as a U-profile the leg surfaces of which in folded position are parallel to the vertical longitudinal central plane of the vehicle, and in the folded-out position are located transverse to said plane while according to its position either the web or one of the leg surfaces provides the tread. Linked to one end of the leg there is also a section of a guard plate which can be folded out of the way. This foldable-type step which is intended mainly for main lines, does not permit the necessary number of steps required for short distance vehicles such as urban and suburban transport vehicles (German Auslegeschrift No. 1 209 589).

Furthermore, still another multi-step entrance arrangement with movable steps has become known which comprises a fixed bottom step and a step that is movable up to the plane of the floor and also a guard plate which is controlled in conformity with the motion of said step while said step, guided in inclined tracks, is in horizontal position displaceable as to height. To this end, a link engages a lever connected to the adjustable step. The free end of the lever is linked to the guard plate. In this case, the fixed bottom step tends to be troublesome in some applications (German Offenlegungsschrift No. 1 816 573).

Finally, there has become known a multi-step entrance arrangement with a movable step which is guided in tracks inclined towards the longitudinal vertical central plane of the vehicle and arranged to be adjustable as to height in a horizontal position by means of a linkage mounted on a shaft fixed to the vehicle. In this case the movable step has vertical spacers provided at its underside to which the other step is pivotably connected, the pivoting motion being controlled by a linkage connected to the shaft. This design is not in all instances sufficiently adaptable as to the desired height (German Offenlegungsschrift No. 2 129 223).

It is, therefore, an object of this invention to improve the known entrance arrangements with moving steps or guard plates or step covers so as to obtain enhanced comfort, better suitability for railway operation, increased safety, and more economic design.

This object and other objects and advantages of the invention will appear more clearly from the following specification in connection with the accompanying drawings, in which.

Figure 1:
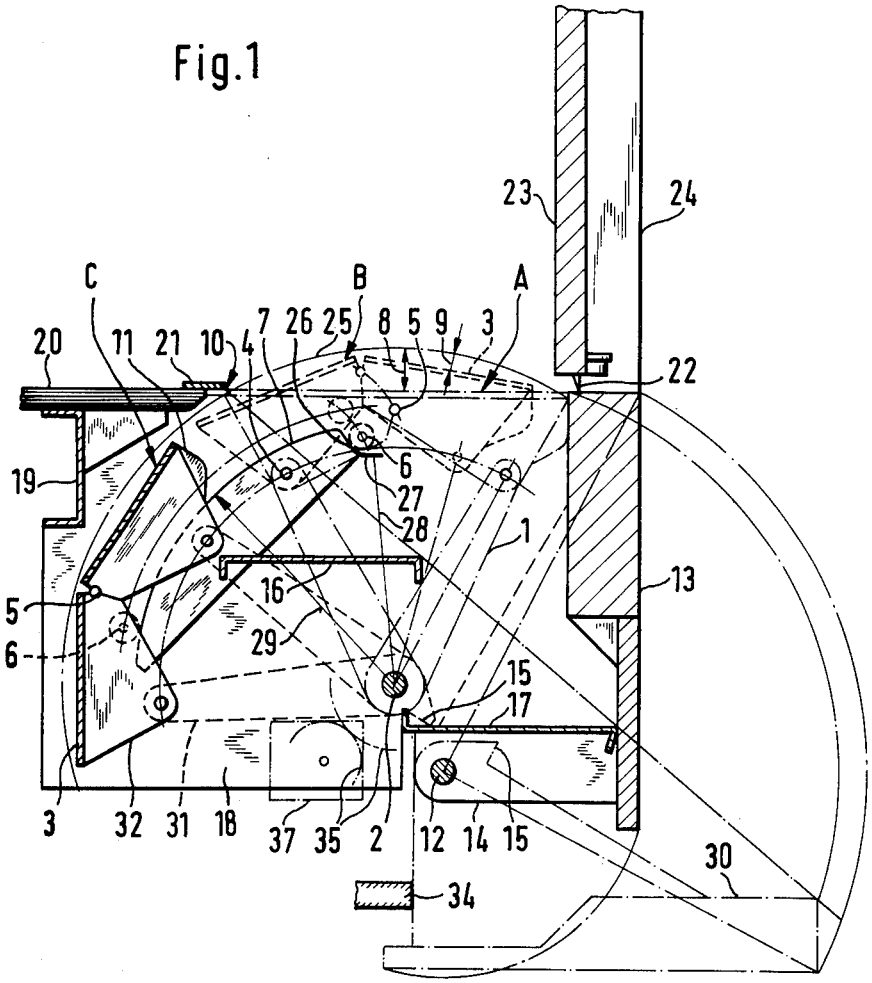
FIG. 1 shows in section an entrance step arrangement according to the invention with two fixed steps, a foldable guard plate and a foldable cover.
Figures 1A, 1B:
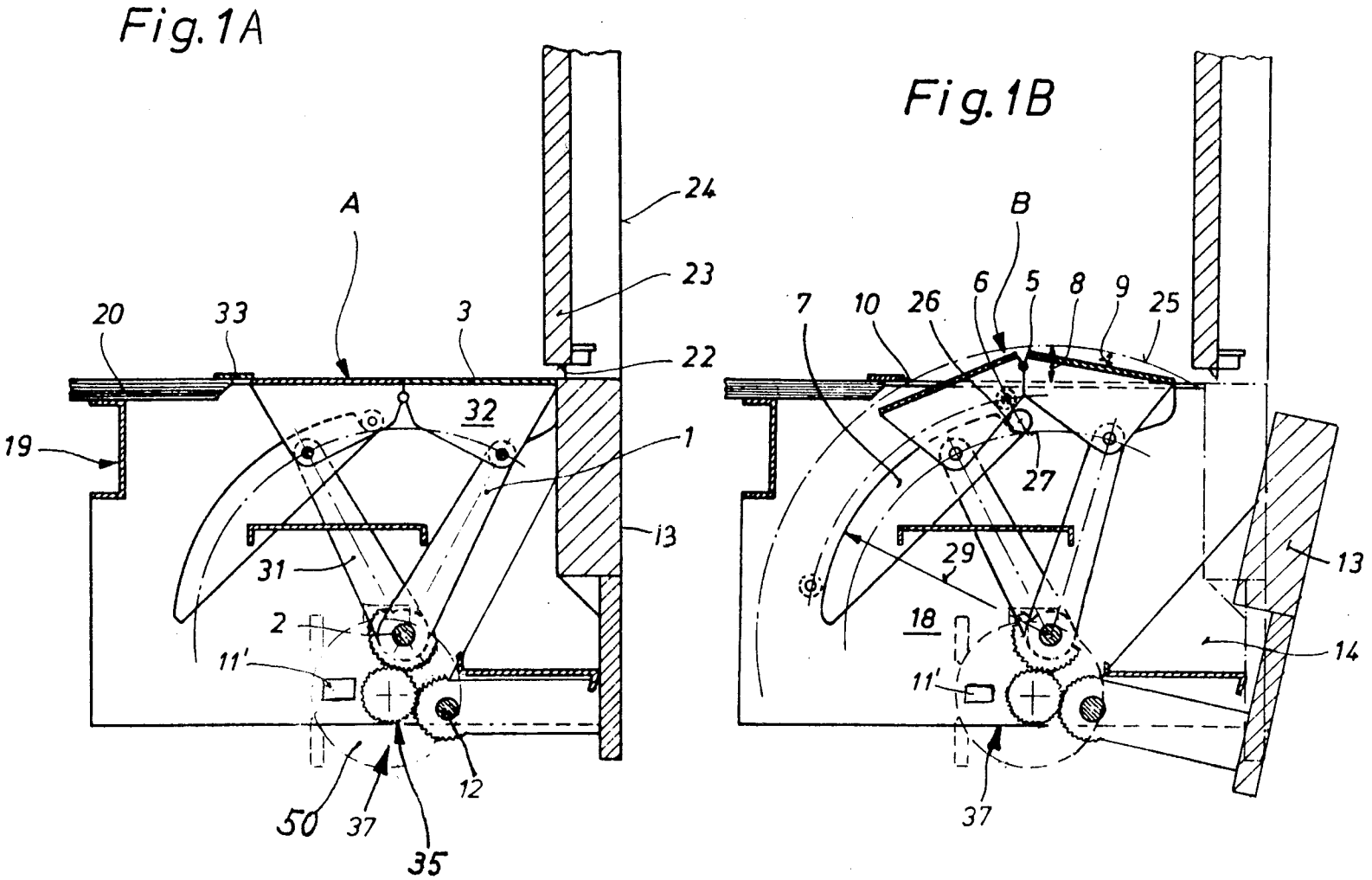
FIG. 1A shows the entrance step arrangement of FIG. 1 in closed position including drive means and gearing therewith.
FIG. 1B shows the step arrangement of FIG. 1 in an intermediate position between closed and open positioning including drive means and gearing therewith.

The entrance arrangement according to the present invention is characterized primarily in that the guard plate pivotable toward the outside is provided with a step-on or tread section, and that the cover for the step is pivotable inwardly behind the tread edge of the floor of the vehicle equipped with said entrance arrangement.

This arrangement brings about the following advantages: With the cover closed, when the vehicle floor extends to the vehicle outline, the major proportion of the weight of the passengers standing on the cover is absorbed by structural elements which can be made very strong and are subject to a low rate of wear.

In the open position, the weight of the cover is completely balanced.

The dual function of the guard plate amounts to a very economical design.

The arrangement according to the invention is hardly liable to disorders and stands up well, even in rough railway operation.

The arrangement is suitable for all common door types of short distance vehicles. Also it is equally suitable to serve high and low-level platforms.

In tramway-type operation or where several stops follow each other with low platform levels, the folding cover need not be raised each time into extended flush (level) position.

As a further development of the invention, a plurality of fixed steps may be provided. This will improve easy boarding and alighting and will facilitate boarding and alighting of disabled persons. According to this improvement, at least four steps are required between the ground level and the floor level in the transport vehicle.

A further embodiment of the invention provides for guide members or cams at the leaves of the folding cover which are movable on a correspondingly shaped cam disc. First of all, this reduces the unfavorable gap between the floor edge and the movable cover. Additionally, part of the load on the cover may by means of the cam disc be conveyed directly to the understructure of the vehicle. Finally, the special shape of the cam disc enables the cover to be fixed in extended position without parts of the actuating mechanism requiring the continued application of power means.

Referring now to the drawings in detail, the side wall of a vehicle generally designated 24 has provided therein a doorway adapted to be closed by any type of vehicle door 23. The doorway is below the level of the floor 20 provided with a step-on system. The door may have any customary seals 22. The entrance recess in the understructure 19 which is not fully shown, has at least one fixed step 16, 17 supported by the sides 18.

At the top, the entrance opening is adapted to be closed by a foldable cover 3 which is flush with the floor 20, and at the outside the entrance opening is adapted to be closed by a guard plate 13 which is pivotable outwardly. The guard plate 13, which, when closed, is flush with the vehicle outline 24, is on its inside provided with a step 30. If desired, the outer surface of the guard plate 13 may be curved to match the contour of the fixed part of the guard plate if said fixed part is curved. The guard plate section 13 is supported by levers 14 (one only being shown). These levers in turn are firmly keyed to the shaft 12 rotatable manually or in any other convenient manner.

The moving parts of the system are hinged or pivoted about horizontal shafts which extend parallel to the outer contour of the vehicle.

The folding-type cover 3 which is sub-divided into at least two leaves is pivotable inwardly behind the tread edge 33 of the floor 20. These leaves are interconnected by hinges 5 in such a manner that, when the cover is pivoted inwardly, its leaves form with each other an angle of more than 180°.

Attached to the leaves of the foldable cover 3, preferably by means of side members 32 are guiding cams 6 designed as rollers which move and are guided on cam discs or curved tracks 7 which have a radius 29 relative to the axis of the cover shaft 2. In that area of track 7 over which the cam 6 passes at the start of the opening movement of cover 3, there is provided a lifting ramp 26. In the closed position of the cover 3, however, the cam 6 is positioned on a saddle-shaped surface 27 of the track 7 which adjoins the raising or lifting ramp 26 with a smaller radius 28.

The leaves of the foldable cover 3 and more specifically its sides 32 are additionally pivotably connected to support arms 1, 31 which in turn are non-rotatably mounted on the cover shaft 2.

Both the cover or second shaft 2 and the guard plate or first shaft 12 are rotatably mounted in the understructure. The first rotatable shaft 12 is arranged in the recess below the floor. Lever means 14 are fixedly connected to the first rotatable shaft 12 and to the guard plate 13 for pivoting the tread from an elevated position to a lowered position.

The cover shaft 2 is adapted to be driven by a conventional mechanism or driving means 37, 38, expediently through the intervention of transmission gears 35 driven by a motor 50. The specific type of mechanism used depends on the desired type of power means (electric power mechanism having an electromotor 50 with lever means **48*a*, 48*b*, compressed air mechanism 42*a*, 42*b* with lever means 44*a*, 44*b* and rod means 43*a*, 43*b*, oil under pressure, etc.). As transmission gears there may be employed spur gears, worm gears or screw spindle transmission gear systems 47*a*, 47*b*, but lever systems 18** may also be used.

The guard plate 13 may be driven in a manner similar to that specifically shown in the drawings.

The maximum pivoting range of the guard plate section 13 is limitable by stop means (e.g. lugs or abutments 34 shown in FIGS. 1 and 19).

Features serving to ensure passenger safety are as follows: The gap 10 is kept small by the guiding cam 6 rolling on the curved track 7. While, in the case of a non-folding cover, the size of the gap would be determined by the relatively high rise 8 on the arc section of the circle 25, with the present invention it is merely necessary to allow for only a substantially reduced rise 9.

In addition, a cover strip 21 consisting of yieldable material, e.g. rubber or in the form of a flexible steel plate, is provided at the tread edge 33.

Further protection against persons getting caught in the gap is provided by a yieldable safety strip 11 located at the front edge of the cover 3. If this safety strip means associated with the driving means 37 is deformed due to contacting the part of a body of a person or an object, this deformation is used to stop further motion of the part liable to cause injuries, in a manner known in the art.

Furthermore safety devices of any known type, e.g. solenoid controlled latching means 11', may prevent raising the step 30 as long as there is a load on it.

Figure 4:
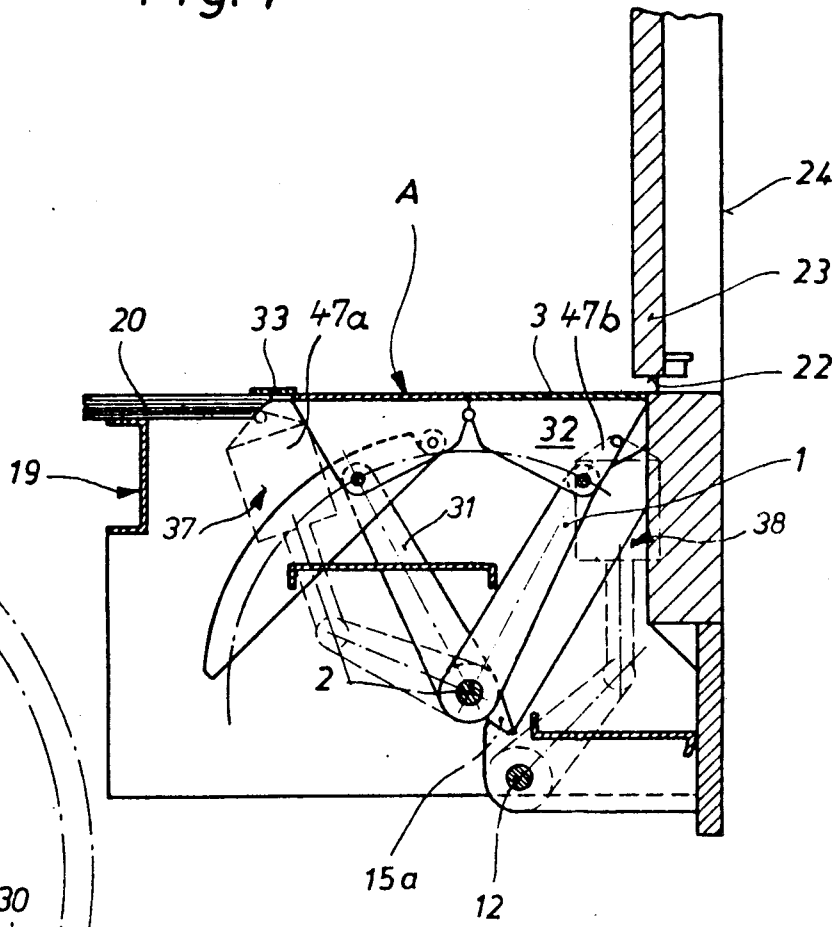
FIGS. 4, 5 and 6 show driving means with electric power mechanism for the embodiment of FIGS. 1, 1A, 1B and 1C.
Figure 1C:
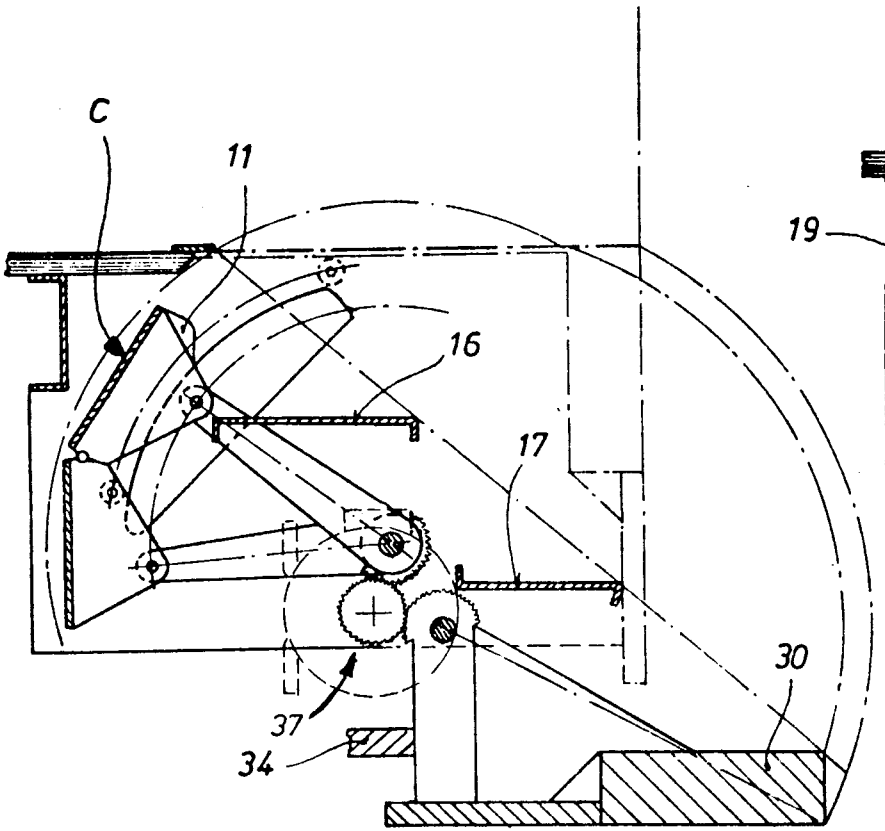
FIG. 1C shows the step arrangement of FIG. 1 in open position including drive means and gearing therewith.
Figure 5:
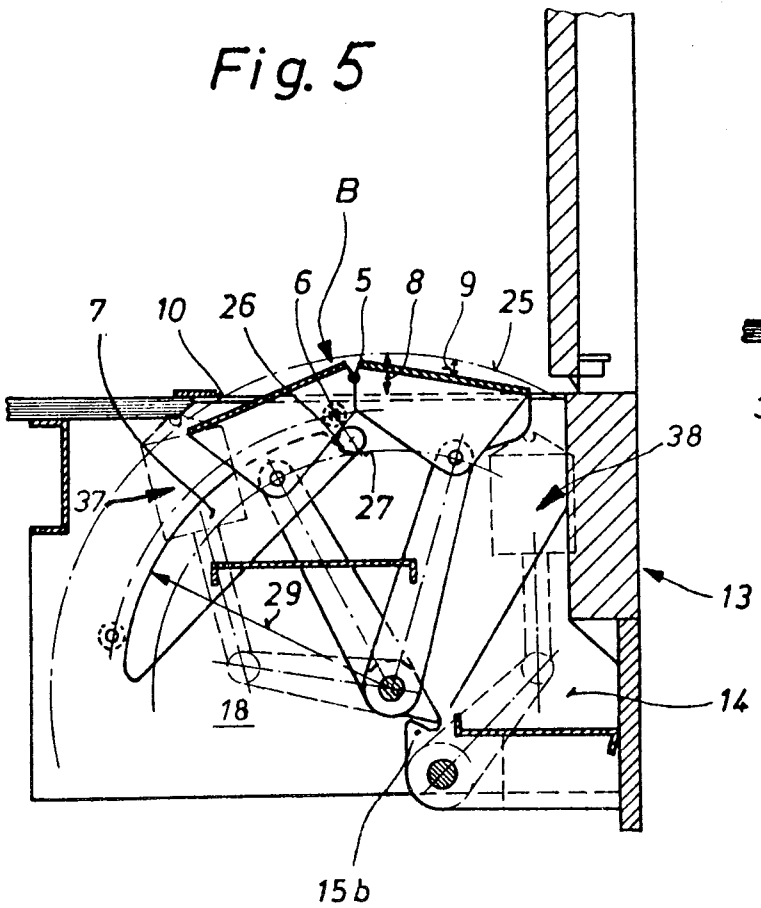
Figure 8:
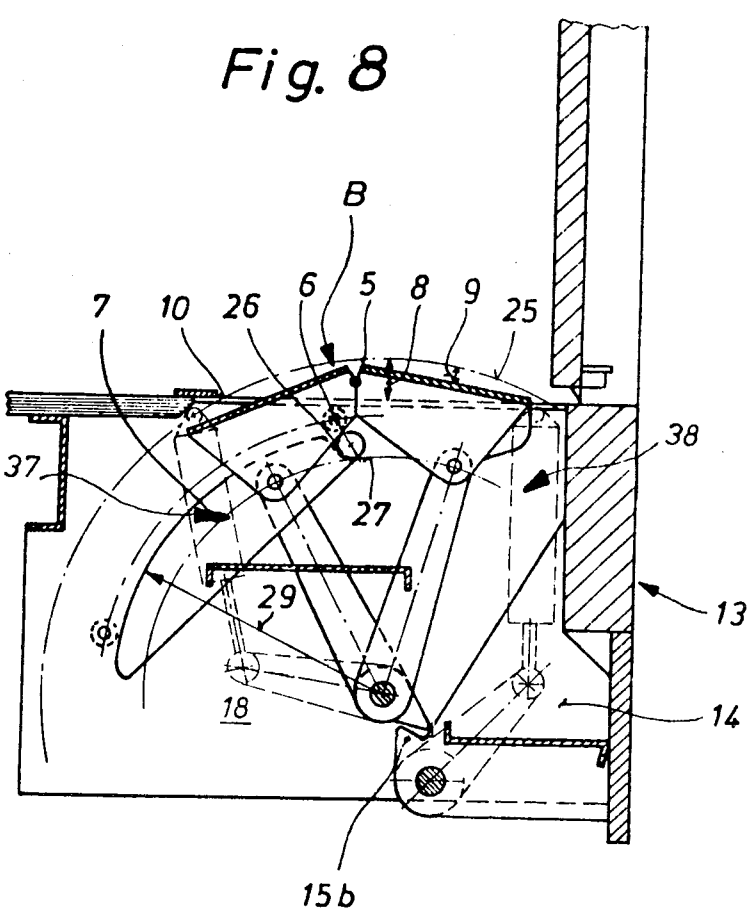
FIGS. 7, 8 and 9 show driving means with compressed air or oil pressure from the embodiments of FIGS. 1, 1A, 1B and 1C.
Figure 7:
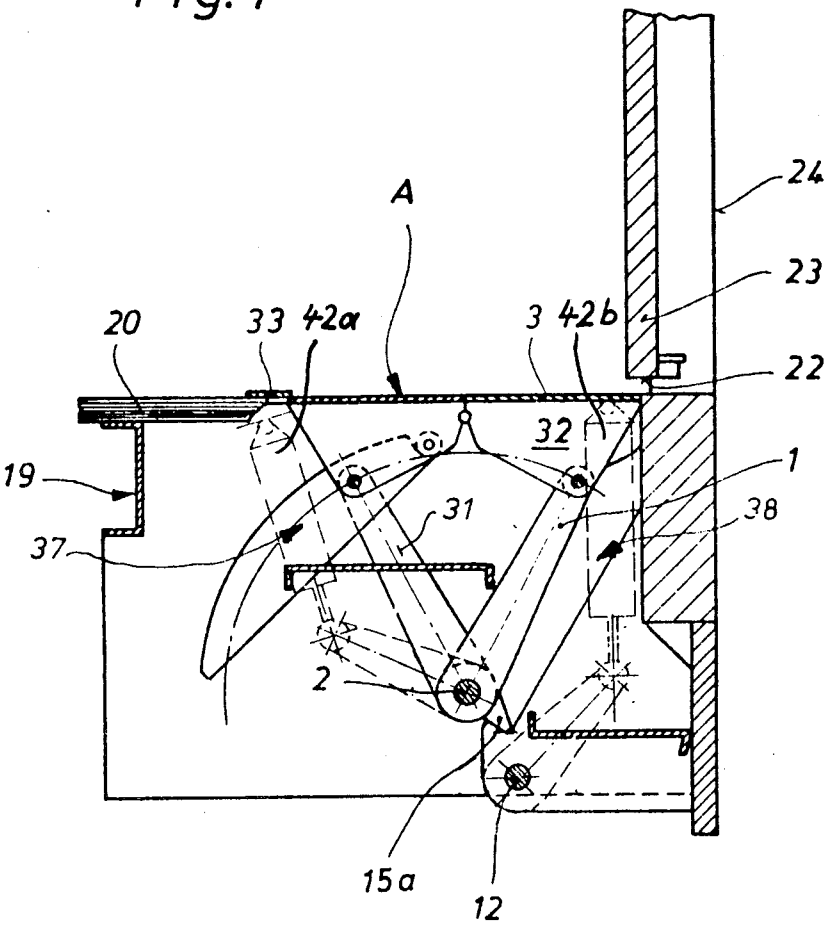
Figure 10:
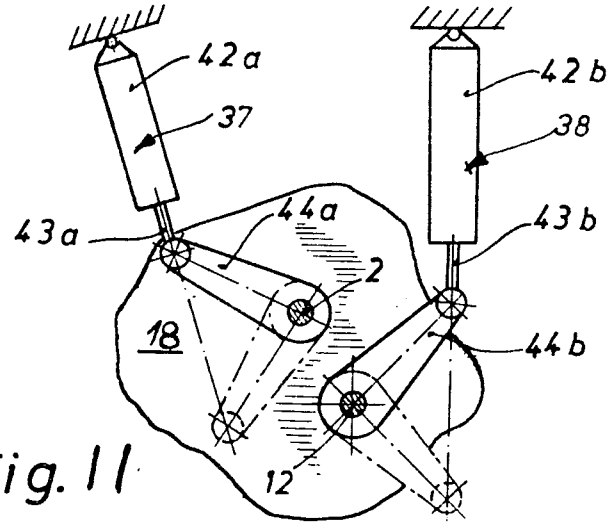
FIG. 10 shows separately the compressed air or oil pressure power means of preceding views.
Figure 11:
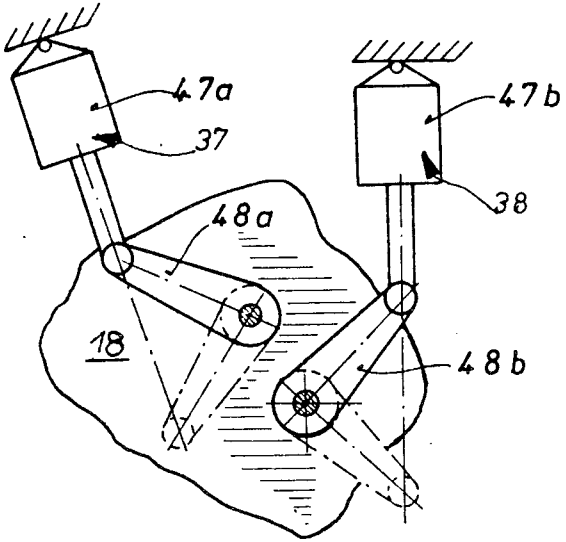
FIG. 11 shows separately the electric power means of preceding views.
Figure 9:
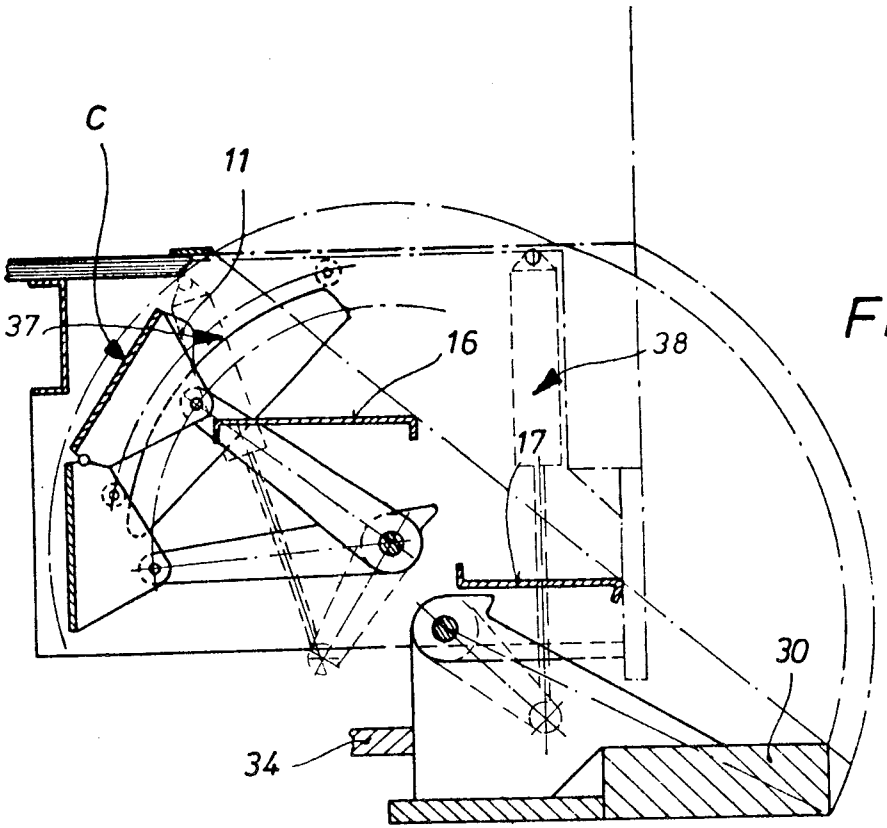
Figure 1B:
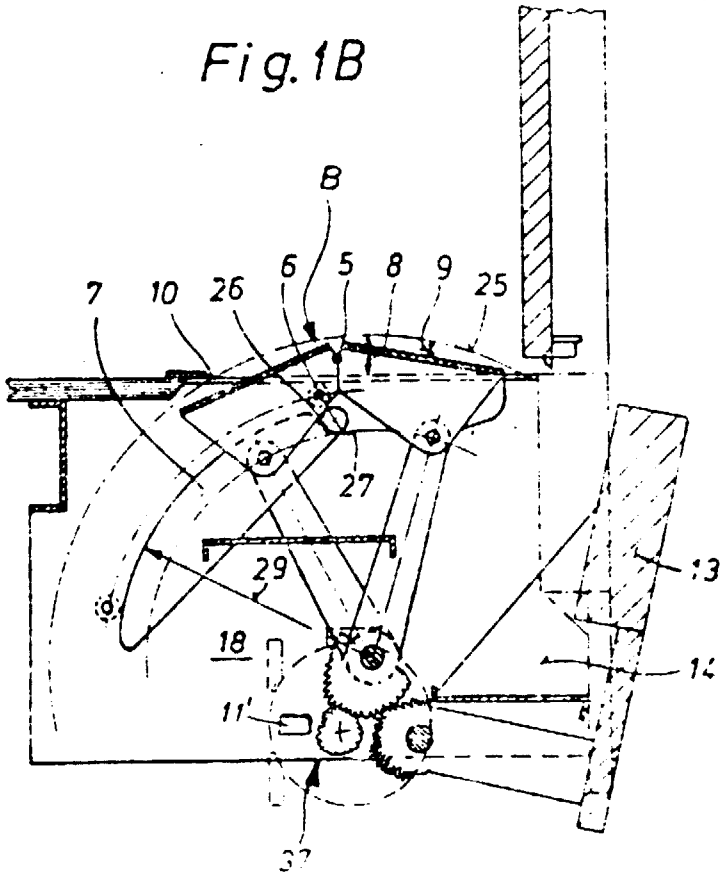
Figure 1A:
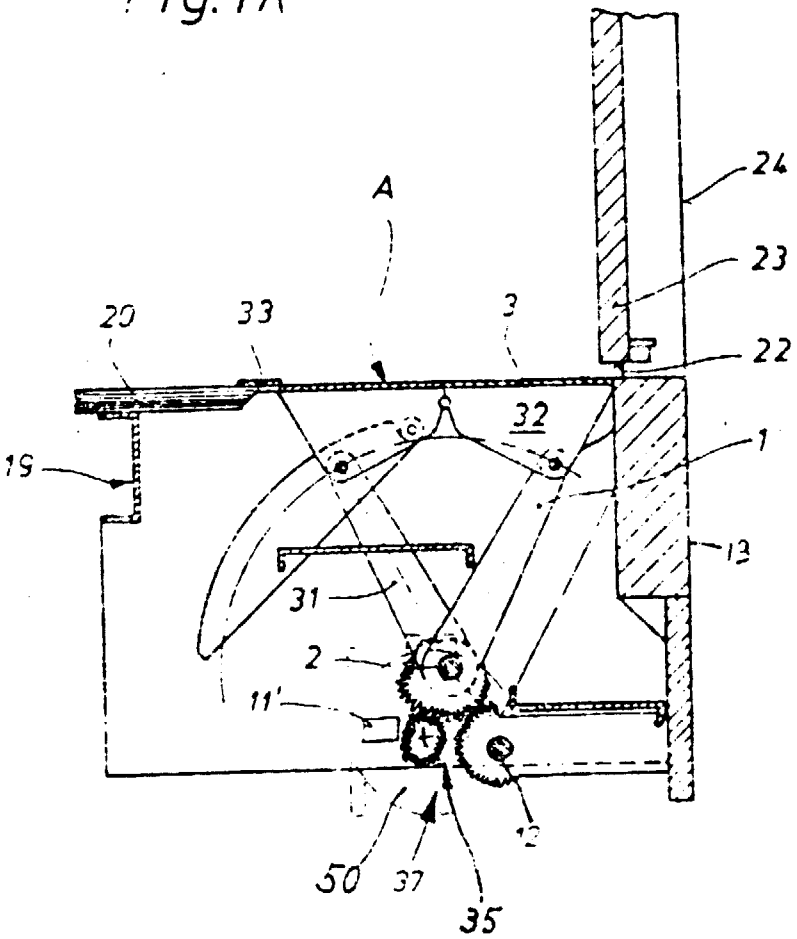
Figure 4:
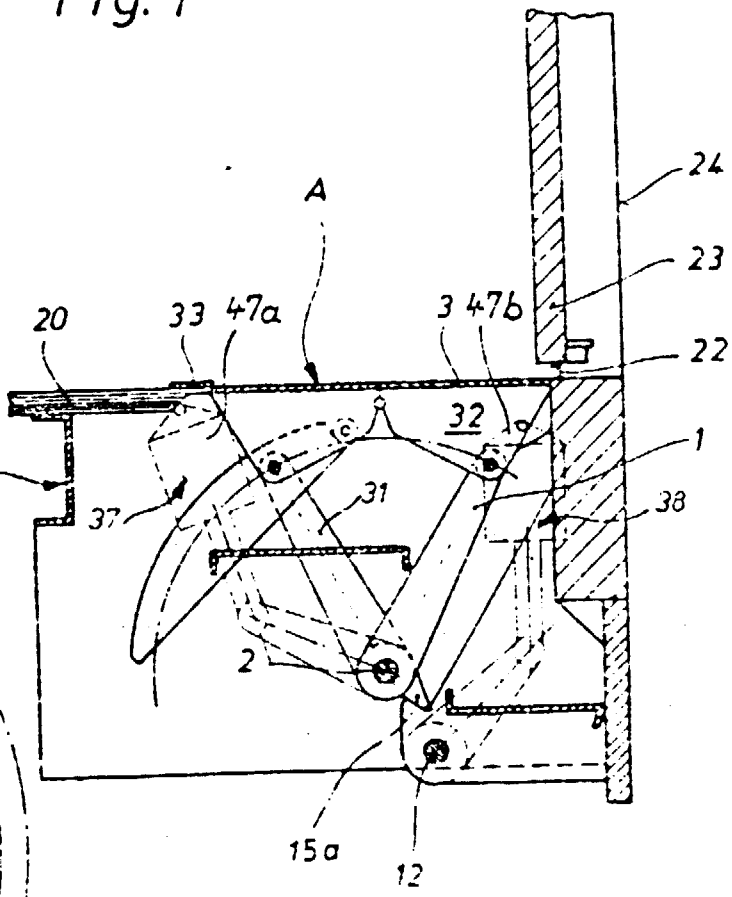
Figure 1C:
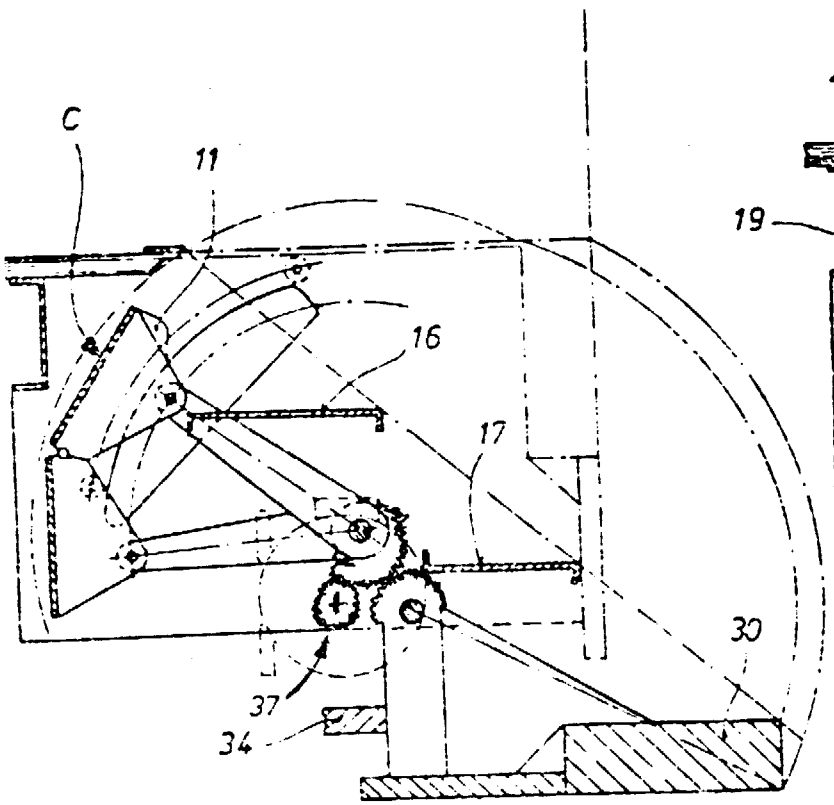

Finally, provision is made to prevent outward pivoting of the guard plate 13 as long as the cover has not pivoted out of the way. This is effected by mechanically locking of the guard plate shaft 12 relative to the cover shaft 2. Such locking may be effected e.g. by the pair of locking members 15 in FIG. 1, 15*a* in FIGS. 4 and 7, 15*b* in FIGS. 5 and 8.

The entrance arrangement according to the present invention offers the following operational possibilities:

When operating on routes with high-level platforms on railway stations, for instance on underground lines, the foldable step cover 3 remains in the horizontal flush position and, consequently, completely covers the recess for the steps. Furthermore, in this case the guard plate 13 would not be pivoted outwardly. In other words, only the doors 23 would have to be operated for loading and unloading passengers.

When it is necessary to serve a stop with a low-level platform, the folding cover would be pivoted inwards from its initial position A into the intermediate position B. Since, to this end, the hinge 5 need be raised only by the difference between the radii 28 and 29, this movement would occur only when no passengers are standing on the cover. Out of the intermediate position B, the cover would then be pivoted into the second position of rest C. Then the guard plate 13 can be pivoted downwardly, and the door 23 opened.

For straight tramway operation, i.e. with passengers boarding and alighting on low-level platforms, the folding cover may remain in position C. Consequently only the guard plate 13 and the door 23 would be operated.

Figure 2:
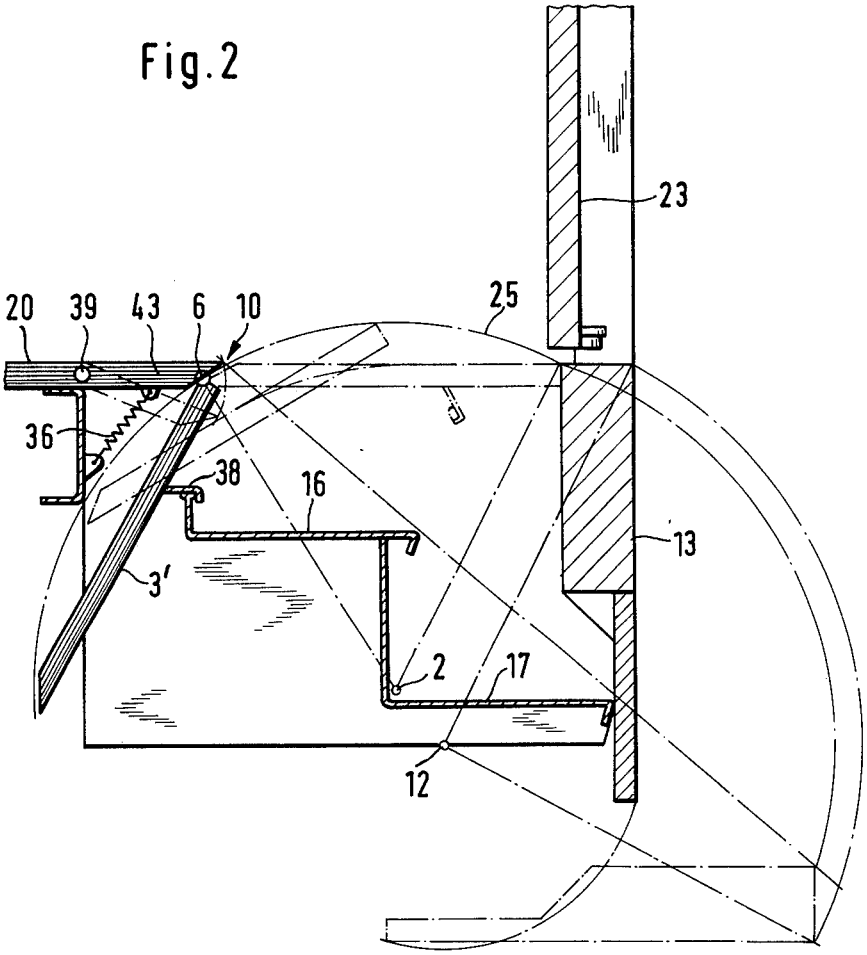
FIG. 2 is a simplified entrance step arrangement according to the invention with a fixed cover and with foldable floor section.

FIG. 2 shows a slightly modified embodiment of the invention where the folding feature of the cover 3' has been omitted; in other words, the cover 3' forms a single integral piece. When low-level platforms have to be served, the cover 3' would be pivoted away in its entirety by means of the cover shaft 2. The guard plate 13 can be pivoted in the manner described above. In order to keep the gap 10 at a minimum, the tread surface of the floor 20 is formed as a floor flap 43 pivotably mounted on a hinge 39. This flap is guided by means of members 6 (preferably rollers) relative to the surface of cover 3'. The movement of the floor flap 43 may be controlled by a spring member 36. In a further embodiment, a cover 38 is provided to close a gap that may exist between the step 16 and the underside of the cover 3'.

Figure 3:
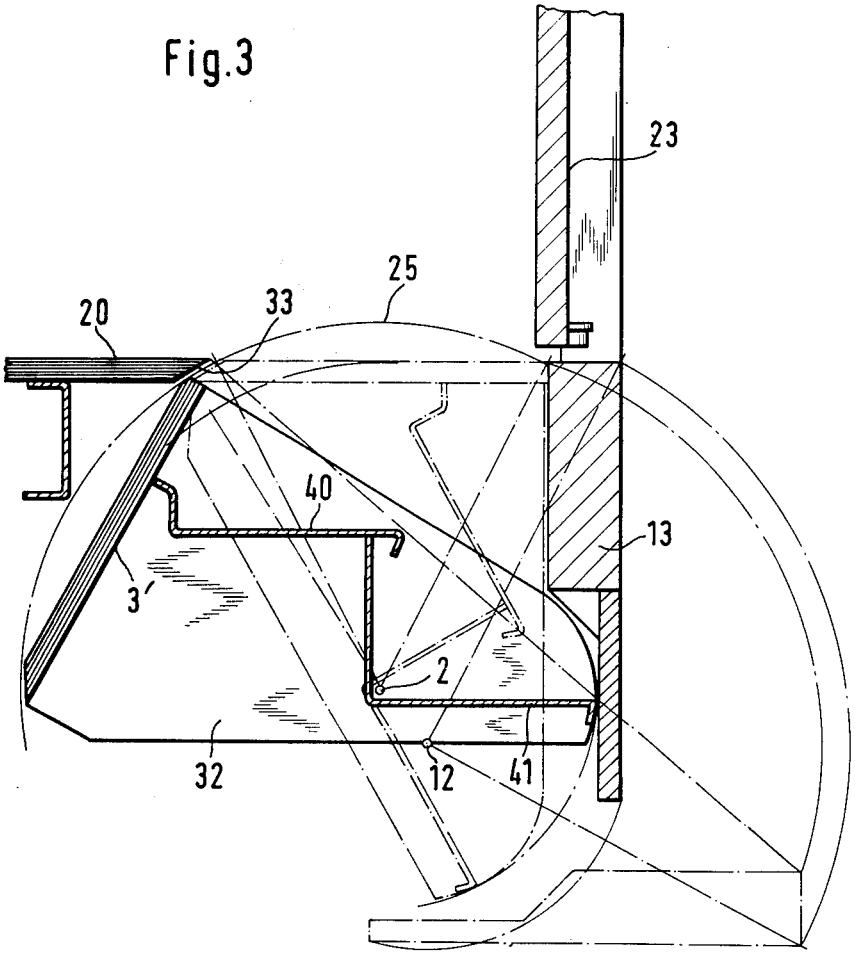
FIG. 3 represents a further simplification of the entrance step arrangement of the invention with a fixed cover and with steps which pivot into position together with the fixed cover.
Figure 6:
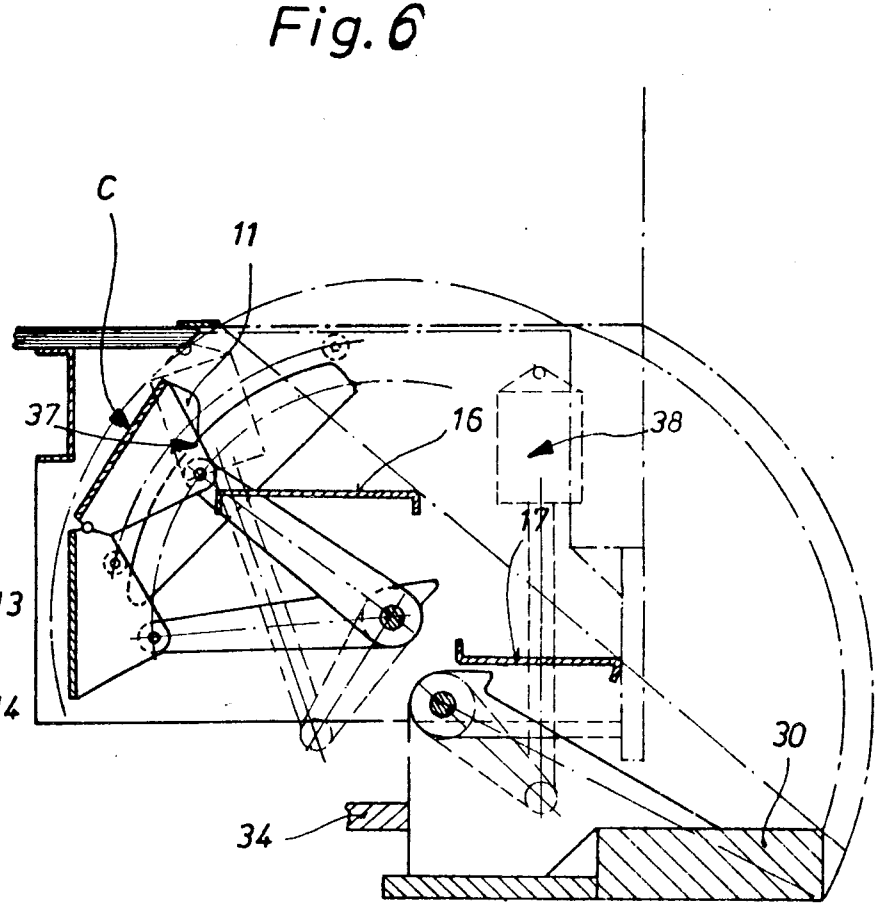

A further simplification can be seen in FIG. 3. Here, the cover 3' together with the steps 40, 41 forms a structure supported by side members 32 which structure can be pivoted on a cover shaft 2. The tread edge 33 of the floor 20 is formed nearly tangentially to the arc of the circle 25.

Unless stated expressly to the contrary, the alternative embodiments of FIGS. 2 and 3 are generally arranged in conformity with the basic embodiments described.

It is, of course, to be understood that the present invention is, by no means, limited to the specific structure shown but also comprises any modifications within the scope of the appended claims.

What I claim is:

1. A vehicle, especially short distance rail vehicle, having a door opening, a door for closing and opening said door opening, flooring means adjacent said door opening and partly defining a recess means below said flooring means, at least one intermediate step arranged in said recess means, a foldable guard plate likewise partly defining said recess means and provided with a tread having an edge therewith, said guard plate being pivotable into a position to a level lower than said at least one intermediate step and offset relative to the latter so as to form a stair-like arrangement with said at least one step, said flooring means having a passage therethrough to permit a person to pass therethrough, foldable cover means including at least two leaves operable selectively to move pivotally from a first position behind the tread edge in which it closes said passage means while forming a part of said flooring means to a second position in said recess in which it frees said passage and is spaced from said foldable guard plate so as to permit a person stepping on said at least one intermediate step to pass through said passage, and guiding cam means including rollers and a track engaged thereby at the start of opening movement of said foldable cover means as well as a saddleshaped surface engaged by the rollers in the second position.

2. A vehicle especially short distance rail vehicle, having a door opening, a door for closing and opening said door opening, flooring means adjacent said door opening and partly defining a recess means below said flooring means, at least one intermediate step arranged in said recess means, a guard plate likewise partly defining said recess means and provided with a tread, said guard plate being pivotable into a position to a level lower than said at least one intermediate step and offset relative to the latter so as to form a stair-like arrangement with said at least one step, said flooring means having a passage therethrough to permit a person to pass therethrough, foldable cover means operable selectively to move pivotally from a first position in which it closes said passage means while forming a part of said flooring means to a second position in said recess in which it frees said passage and is spaced from said guard plate so as to permit a person stepping on said at least one intermediate step to pass through said passage, track means in said recess means, means movable on said track means and supporting said cover means, said track means having an outer curved contour and also having a lifting ramp extending from a radius offset inwardly of said outer curved contour to said outer curved contour.

3. A vehicle according to claim 2, in which two steps are stationarily arranged in said recess means and located between said flooring means and said tread when said guard plate is in its lower level position.

4. A vehicle according to claim 2, in which said cover means is foldable and is provided with roller means movable on the track means, and in which track means are arranged in said recess means for guiding said roller means and thereby said cover means into and out of said first position.

5. A vehicle according to claim 4, in which said foldable cover means is provided with safety strip means located at that side of said foldable cover means which points toward said door.

6. A vehicle according to claim 2, in which said lifting ramp is continued by a saddle-shaped section.

7. A vehicle according to claim 2, which includes: a rotatable shaft, supporting levers linked to said cover means, and being fixedly connected to said rotatable shaft.

8. A vehicle according to claim 2, which includes a first rotatable shaft arranged in said recess, and lever means fixedly connected to said rotatable shaft and to said guard plate for pivoting said tread from an elevated position to a lowered position.

9. A vehicle according to claim 8, which includes abutment means for engagement with said guard plate for defining said downward position of said tread and preventing downward pivoting of said tread beyond said downward position.

10. A vehicle according to claim 8 which includes a second rotatable shaft and lever means fixedly connected to said second rotatable shaft and pivotally connected to said cover means, and driving means respectively drivingly connected to said first and second rotatable shafts.

11. A vehicle according to claim 10, in which said intermediate step is stationary, and in which said cover means is a single piece cover and is pivotable by said first rotatable shaft behind said intermediate step when viewed from said guard plate.

12. A vehicle according to claim 10, in which the flooring means adjacent said single piece cover includes a pivotal section pivotable to reduce the gap between said pivotal section and said single piece cover when the latter is in substantial alignment with said flooring, cam means and spring support means aiding the pivotal gap reducing movement of said pivotal section.

13. A vehicle according to claim 12, in which said at least one intermediate step forms a structural unit with said cover means, said structural unit being pivotable by said second rotatable shaft.

14. A vehicle according to claim 10, which includes safety means associated with said driving means and deformable responsive to the presence of a passenger for preventing removing of said cover means out of its covering position.

15. A vehicle according to claim 2, which includes locking means associated with said driving means for said cover means and guard plate for preventing faulty operations of said cover means and guard plate.

* * * * *

UNITED STATES PATENT AND TRADEMARK OFFICE

CERTIFICATE OF CORRECTION

PATENT NO. : 4,175,495

DATED : Nov. 27, 1979

INVENTOR(S) : Karl-Heinz Kleim

It is certified that error appears in the above-identified patent and that said Letters Patent are hereby corrected as shown below:

The sheets of drawings containing Figures 1A, 1B, 1C and 4, should be canceled and the attached sheets of drawings substituted therefor.

Signed and Sealed this

*Third* Day of *June 1980*

[SEAL]

*Attest:*

SIDNEY A. DIAMOND

*Attesting Officer*

*Commissioner of Patents and Trademarks*